US005551120A

United States Patent [19]

Cipolla et al.

[11] Patent Number: 5,551,120

[45] Date of Patent: Sep. 3, 1996

[54] CONVERSION ASSEMBLY FOR VACUUM CLEANERS

[75] Inventors: Mark E. Cipolla, Chardon, Ohio; David M. Wert, Atlanta, Ga.

[73] Assignee: Royal Appliance Mfg. Co., Cleveland, Ohio

[21] Appl. No.: 390,655

[22] Filed: Feb. 17, 1995

[51] Int. Cl.[6] ..... A47C 5/32

[52] U.S. Cl. ..... 15/333; 15/334; 15/361

[58] Field of Search ..... 15/333, 361, 334

[56] References Cited

U.S. PATENT DOCUMENTS

| | | | |
|---|---|---|---|
| 2,046,684 | 7/1936 | Hoover | 15/334 |
| 2,218,035 | 10/1940 | Benson . | |
| 2,259,386 | 10/1941 | Luse . | |
| 2,333,494 | 11/1943 | Snyder . | |
| 2,372,033 | 3/1945 | Taylor . | |
| 2,691,792 | 10/1954 | Humphrey | 15/333 |
| 2,734,219 | 2/1956 | Kaufman . | |
| 2,763,887 | 9/1956 | Brace . | |
| 3,579,699 | 5/1971 | Balzer . | |
| 3,879,797 | 4/1975 | Principe et al. . | |
| 4,376,322 | 3/1983 | Lockhart et al. . | |
| 4,446,594 | 5/1984 | Watanabe et al. . | |
| 4,573,236 | 3/1986 | Dyson | 15/333 |
| 4,811,450 | 3/1989 | Steadings . | |
| 4,811,452 | 3/1989 | Sumerau | 15/333 X |
| 4,823,429 | 4/1989 | Petralia . | |
| 5,134,750 | 8/1992 | King et al. . | |
| 5,222,276 | 6/1993 | Glenn, III . | |
| 5,243,734 | 9/1993 | Maurer et al. . | |
| 5,247,720 | 9/1993 | Sovis et al. . | |
| 5,255,411 | 10/1993 | Da Costa . | |
| 5,269,042 | 12/1993 | Stephens et al. . | |
| 5,351,361 | 10/1994 | Buchtel . | |

*Primary Examiner*—Chris K. Moore

[57] ABSTRACT

A suction cleaner adapted for either on the floor cleaning or above the floor cleaning includes a base having a nozzle and a handle pivotally secured to the base so as to be pivotable between a use position and a non-use position. A suction passageway is located in at least one of the base and the handle and communicates with the nozzle. A valve is rotatably mounted in the suction passageway for selectively closing the suction passageway. An elevating mechanism selectively elevates the nozzle away from, and lowers the nozzle towards, a subjacent support surface, the mechanism being secured to the base. An actuating mechanism manually actuates the elevating mechanism. The actuating mechanism is secured to at least one of the base and the handle and engages both the valve and the elevating mechanism. The actuating mechanism is selectively engaged by a portion of the handle so that when the handle is pivoted to the non-use position, the actuating mechanism drives the elevating mechanism to elevate the nozzle from the subjacent floor surface and also drives the valve to close the suction passageway.

26 Claims, 13 Drawing Sheets

CONVERSION ASSEMBLY FOR VACUUM CLEANERS

BACKGROUND OF THE INVENTION

The present invention relates to vacuum cleaners. More particularly, the instant invention relates to improvements in a conversion mechanism for converting an upright vacuum cleaner between an on-the-floor cleaning mode and an above-the-floor cleaning mode as desired.

Many vacuum cleaners heretofore developed and presently available are capable of both on-the-floor cleaning and above-the-floor cleaning. Such convertible vacuum cleaners usually employ a suction generating fan and some sort of valve for controlling the application of the suction developed by the fan either to a floor nozzle or to an auxiliary suction inlet located on the housing of the cleaner. One end of a flexible suction hose can be selectively attached to the auxiliary suction inlet. The opposite end of the hose is usually adapted to receive one of a variety of tools, such as brushes, wands and the like, suited for above-the-floor cleaning.

When an upright vacuum cleaner has its handle moved to a non-use or vertical position, it is advantageous to space the nozzle, and the brushroll rotating adjacent thereto, away from the subjacent floor surface so as to prevent the brushroll from wearing a groove in the carpeting or the like on the floor by continued rotation thereagainst. It is also necessary to cut off suction flow from the nozzle in order to enable the fan of the vacuum cleaner to pull a suction at the auxiliary suction inlet. For the latter function, a suction control valve is utilized.

Conversion arrangements for vacuum cleaners have taken many forms. These include the use of an insertable conversion coupling for actuating the suction control valve, hand actuation of the conversion valve, actuating the conversion valve via a pedal and valve actuation via a movement of the handle of the vacuum cleaner. For each of these conversion arrangements, the brushroll also needs to be moved away from the floor surface when converting the vacuum cleaner for off-the-floor cleaning. However, very few of these arrangements have actuated the conversion valve to shut off suction flow from the nozzle and simultaneously moved the brushroll away from the subjacent surface.

One such combined nozzle height elevation arrangement and hose conversion valve arrangement is known. However, this known arrangement employs a rectilinearly moving valve and, therefore, needs a relatively complicated conversion mechanism to both actuate the valve and move the brushroll away from the subjacent floor surface.

Accordingly, it has been considered desirable to develop a new and improved convertible vacuum cleaner which would overcome the foregoing difficulties and others while providing better and more advantageous overall results.

BRIEF SUMMARY OF THE INVENTION

In accordance with the present invention, a suction cleaner is provided which is adapted for either on the floor or above the floor cleaning.

More particularly in accordance with this aspect of the invention, the suction cleaner comprises a base including a nozzle, a handle pivotally secured to the base so as to be pivotable between a use position and a non-use position and a suction passageway located in at least one of the base and the handle and communicating with the nozzle. A valve is rotatably mounted in the suction passageway for selectively closing the suction passageway. An elevating means is provided for selectively elevating the nozzle from, and lowering the nozzle towards, a subjacent floor surface, the elevating means being secured to the base. An actuating means is provided for manually actuating the elevating means. The actuating means is secured to at least one of the base and the handle and engages both the valve and the elevating means. The actuating means is selectively engaged by a portion of the handle so that when the handle is pivoted to the non-use position, the actuating means drives the elevating means to elevate the nozzle from the subjacent floor surface and also drives the valve to close the suction passageway.

Preferably, the actuating means comprises a roller lifter pivotally secured to the base and an interengaging member which connects the roller lifter to the valve. The interengaging member can comprise a cylindrical body having a hollow interior, an arm extending away from the body, a first finger extending away from the body located on one side of the arm and a second finger extending away from the body and located on the other side of the arm.

The roller lifter can comprise a body having a hollow interior section defined by a pair of arms, a pin secured to the body, a bridge extending across the hollow interior between the arms, a first contact surface defined on the body and a second contact surface defined on the body wherein the second contact surface is spaced from the first contact surface. If desired, the interengaging member can comprise an arm which is positioned in the hollow interior section of the roller lifter body and engages the bridge thereof, and a sleeve which engages a stem of the valve.

Preferably a first biasing means is provided for urging the valve in a first direction in relation to the suction passageway, the first biasing means being mounted on the sleeve. If desired, a second biasing means can be provided for urging the interengaging member in a first direction. The second biasing means can be mounted on the sleeve in a spaced manner from the first biasing means. If desired, a locking means can be provided for locking the handle in the non-use position.

The suction cleaner can further comprise a height adjusting mechanism which cooperates with the elevating means. The height adjusting mechanism can comprise a manually accessible knob, a cam member secured to the knob and a pin slidably mounted in the base wherein the pin has an upper end which engages the cam member and a lower end which engages the elevating means so that movement of the cam member moves the pin and consequently the elevating means.

One advantage of the present invention is the provision of a new and improved convertible vacuum cleaner.

Another advantage of the present invention is the provision of a convertible vacuum cleaner which is low in cost and easy to manufacture, but is sturdy and is capable of withstanding prolonged use.

Still another advantage of the present invention is the provision of a convertible vacuum cleaner which enables both on-the-floor cleaning operations, with the aid of a rotating brushroll, as well as above-the-floor cleaning operations and which can be readily switched from one mode to the other.

Yet another advantage of the present invention is the provision of a convertible vacuum cleaner in which a movement of the vacuum cleaner's handle to the upright position simultaneously closes a suction conduit communicating with the nozzle and spaces the nozzle away from the subjacent floor surface so as to remove the brushroll located at the nozzle from contact with the floor surface.

A further advantage of the present invention is the provision of a convertible vacuum cleaner which has an elevating means for selectively elevating the nozzle from and lowering the nozzle towards a subjacent floor surface, a valve for selectively closing a suction passageway communicating with the nozzle and a conversion means which acts on both the elevating means and the valve. The conversion means is selectively engaged by a portion of a handle of the vacuum cleaner so that when the handle is pivoted to a non-use position, the conversion means acts on the elevating means to raise the nozzle from the subjacent floor surface and the conversion means simultaneously drives the valve to close the suction passageway.

A still further advantage of the present invention is the provision of a nozzle height adjustment mechanism which cooperates with an elevating means that selectively elevates the nozzle from, and lowers the nozzle towards, a subjacent floor surface. The nozzle height adjustment mechanism includes a manually accessible knob which, upon rotation, moves a cam member that engages one end of the pin. The other end of the pin acts on the elevating means.

A yet further advantage of the present invention is the provision of an upright vacuum cleaner which is convertible from an on-the-floor cleaning operation to an above-the-floor cleaning operation. The vacuum cleaner includes a handle pivoted in an upstanding manner to a base having a nozzle wherein the handle can be supported by the base in any one of three discrete orientations. The handle can be moved between these orientations by depressing a pedal pivotally mounted on the base.

Still other benefits and advantages of the invention will become apparent to those of average skill in the art upon a reading and understanding of the following detailed specification.

BRIEF DESCRIPTION OF THE DRAWINGS

The invention may take form in certain parts and arrangements of parts, a preferred embodiment of which will be illustrated in the accompanying drawings which form a part hereof and wherein.

DETAILED DESCRIPTION OF THE PREFERRED EMBODIMENT

Figure 1:
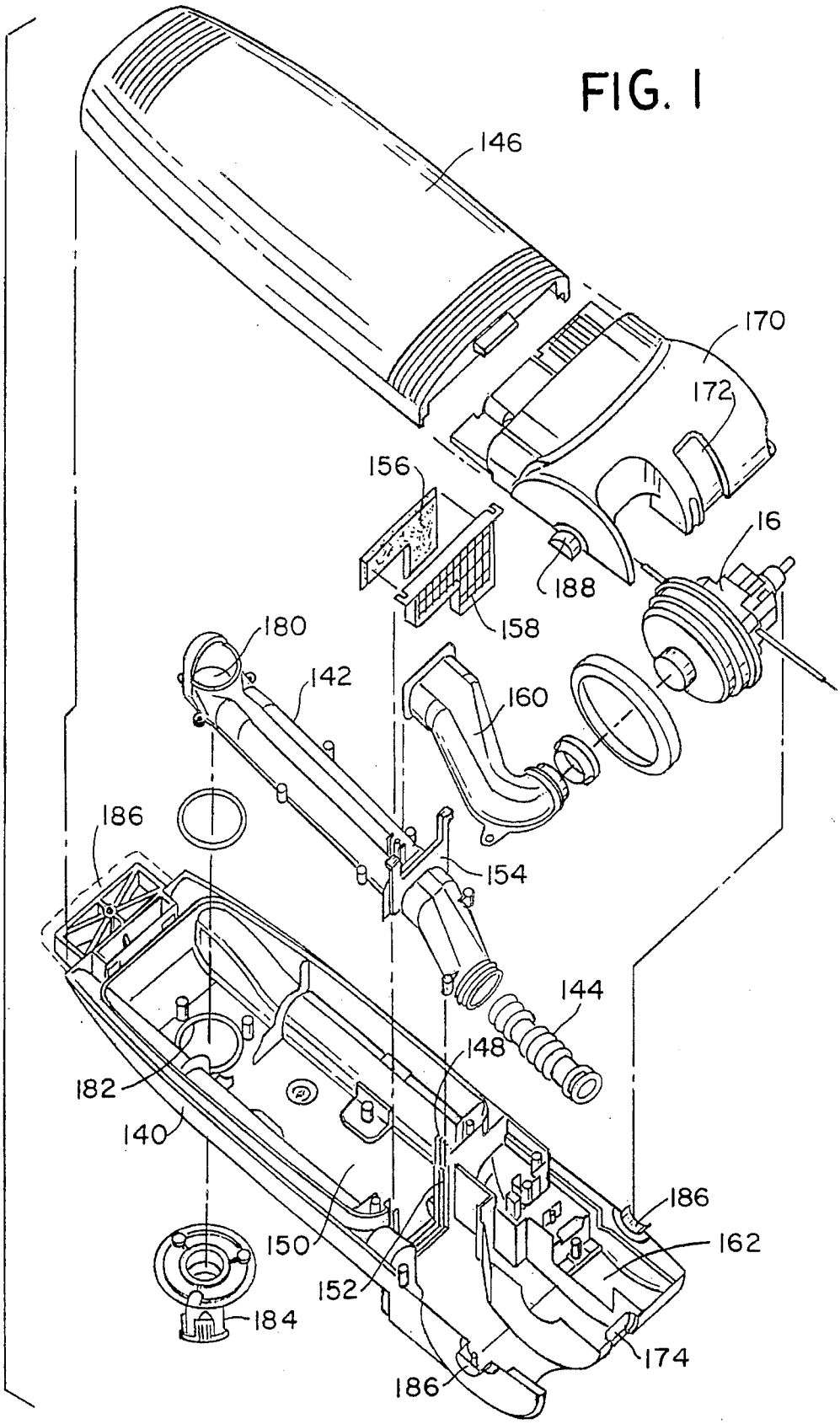
FIG. 1 is an exploded perspective view of a handle portion of the vacuum cleaner according to the present invention.
Figure 5:
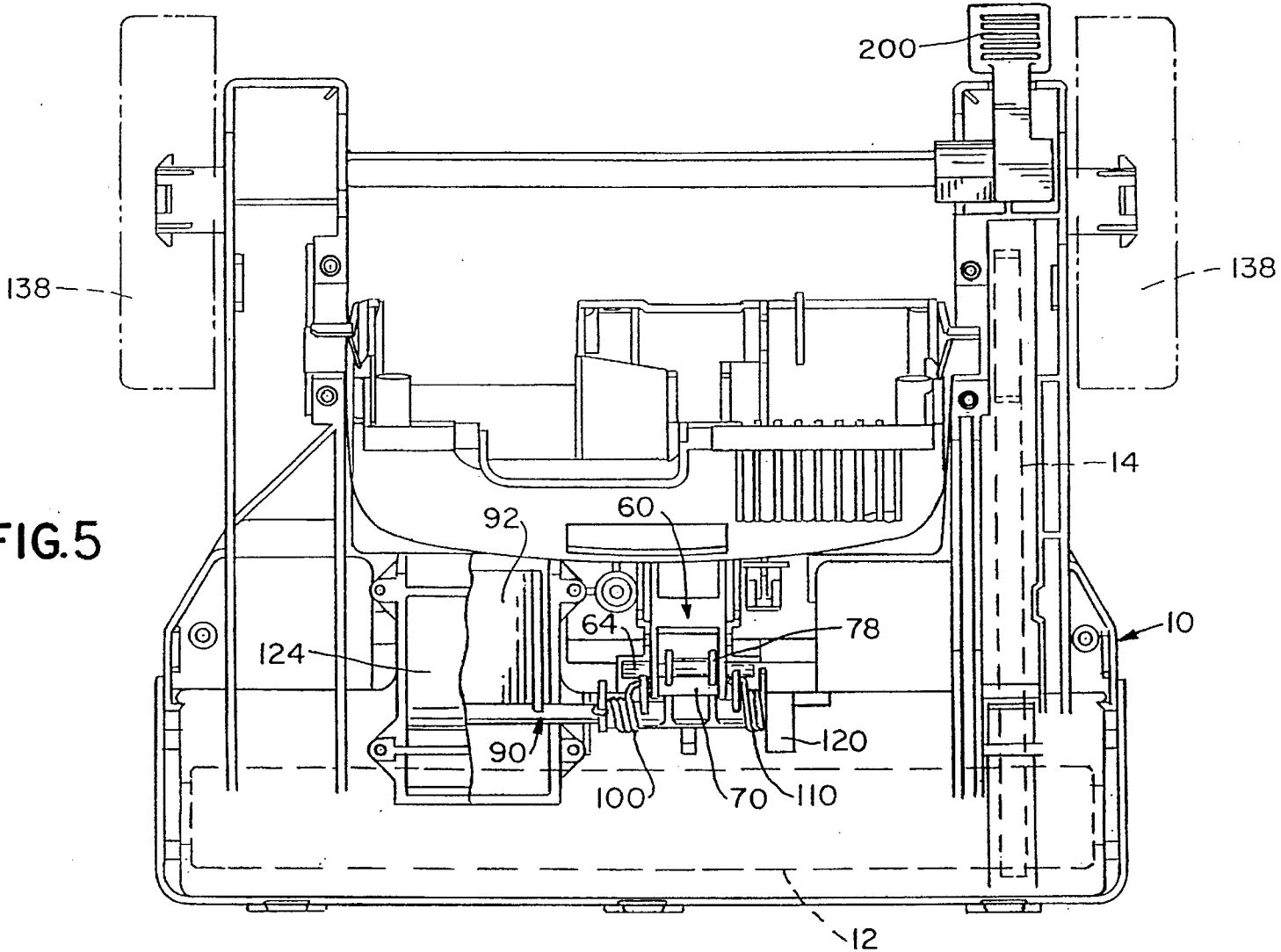
FIG. 5 is an assembled top plan view of the base of FIG. 3 with certain parts broken away for clarity.

Referring now to the drawings wherein the showings are for purposes of illustrating a preferred embodiment of the invention only and not for purposes of limiting same, FIG. 1 shows a handle portion of the vacuum cleaner according to the present invention while FIG. 5 shows a base portion thereof. While the valving and nozzle raising structure illustrated herein is primarily designed for, and will hereinafter be described in connection with a specific type of upright convertible vacuum cleaner, it should be appreciated that several of the features disclosed herein can be adapted for use in many different types of convertible vacuum cleaners as well as other types of vacuum cleaners.

With reference first to FIG. 5, the vacuum cleaner comprises a nozzle base 10 which is meant for travel over a subjacent floor surface. Rotatably mounted in the base 10 is a conventional brushroll 12 driven by a belt 14. The belt is rotated by a motor 16 (FIG. 1).

Figure 2:
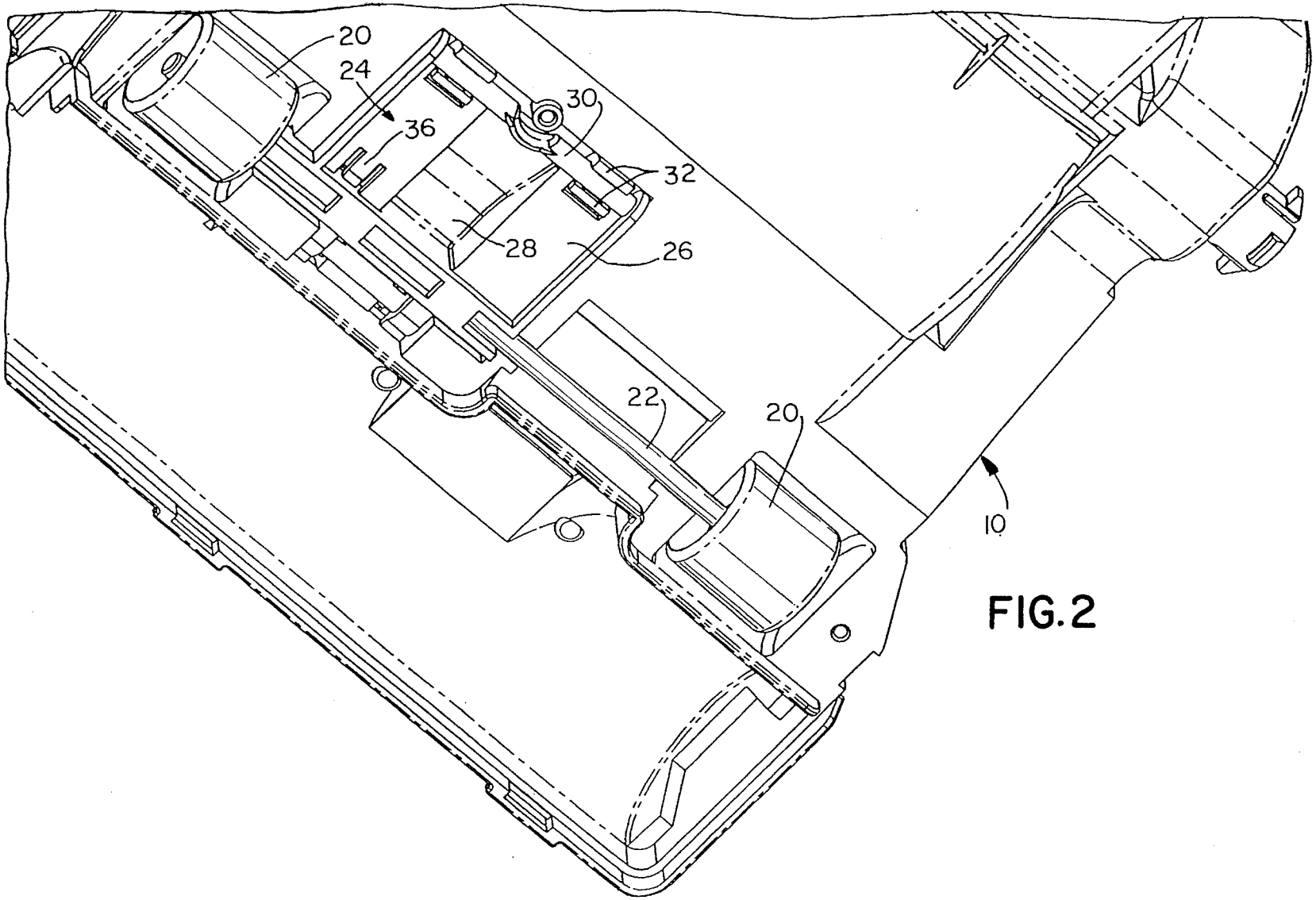
FIG. 2 is an enlarged perspective view of a base portion of the vacuum cleaner according to the present invention.
Figure 4:
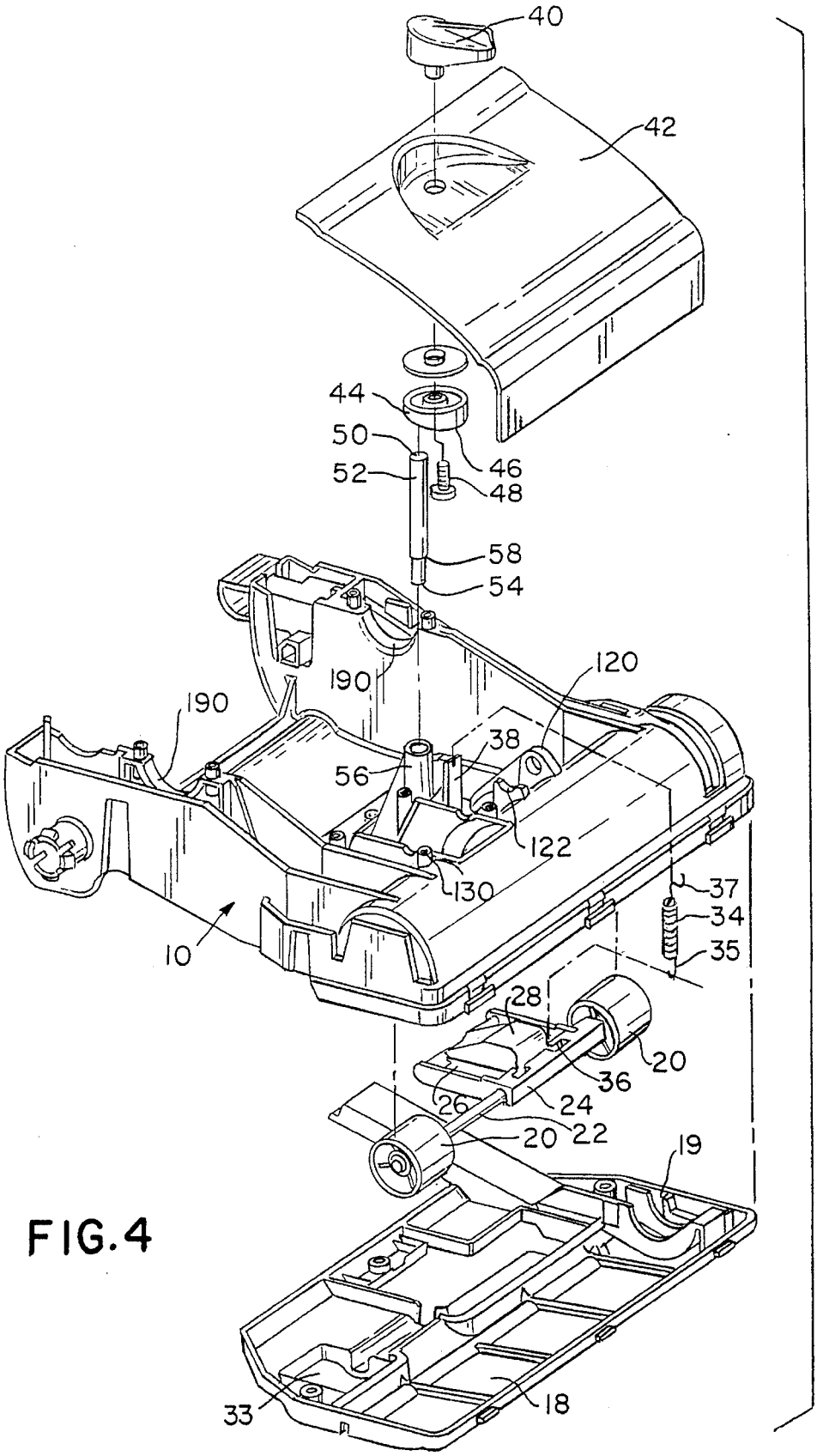
FIG. 4 is an exploded perspective view of parts of the base of FIG. 3.

With reference now to FIG. 4, the brushroll 12 is mounted at a nozzle or suction inlet 18 located in a nozzle guard 19 that is secured to the base 10. Rotatably mounted on the base is a nozzle raising assembly including a pair of front rollers or wheels 20 which are rotatably mounted on an axle 22. A cam follower plate 24 is secured on the axle so that the axle can rotate in relation thereto. The plate includes a flat surface section 26 located adjacent to a ramped surface section 28. With reference now also to FIG. 2, located on a distal end of the plate 24 in spaced relation to the surfaces 26 and 28 is a cross pin 30 which can be accommodated between two pairs of fingers 32 mounted on a bottom surface of the nozzle base 10. This structure allows the cam follower plate 24 to pivot in relation to the nozzle base thereby allowing the axle 22, and the wheels mounted thereon, to move in relation to the base 10.

With reference again to FIG. 4, an aperture 33 is located on each side of the nozzle guard 19 to accommodate each of the front wheels 20 of the vacuum cleaner. A spring 34 has a lower end 35 which extends around a finger 36 (FIG. 2) of the cam follower plate 24. An upper end 37 of the spring extends over a stem 38 extending upwardly in the base 10. The spring resiliently biases the axle 22 towards the nozzle base 10, thereby bringing the nozzle 18 close to the subjacent surface.

A height adjusting knob 40 is located atop a cover 42 of the nozzle base 10. The adjusting knob is rotatably mounted on the cover 42 and cooperates with a cam 44 having a plurality of cam surfaces 46 thereon. Preferably, four such surfaces are provided. The cam 44 is preferably circular and is secured to the height adjusting knob 40 via a fastener 48. Cooperating with the cam surfaces 46 is an upper end 50 of a pin 52. A lower end 54 of the pin engages the flat surface 26 of the cam follower plate 24. The pin is slidably mounted in a tube 56 secured on the nozzle base 10. Preferably the pin has a shoulder 58 which cooperates with a constriction (not visible) in the tube 56 to prevent the pin from falling through the tube. Rotation of the knob 40 changes which cam surface 46 contacts the pin 52. Rotation clockwise pushes the pin downwardly in the tube 56, since a larger cam surface 46 bears on pin end 50, forcing the pin's bottom end 54 to push against the plate flat surface 26 urging the plate to pivot on pin 30 around the base 10, raising the nozzle 18. Counter-clockwise rotation of the knob 40 will rotate the cam so as to bring one of the smaller cam surfaces 46 into contact with the pin upper end 50, thereby allowing the pin 52 to retract into the tube 56. This allows the cam follower plate 24 to be pulled by the spring 34 toward the base 10, thus retracting the wheels 20 and lowering the nozzle 18.

Figure 3:
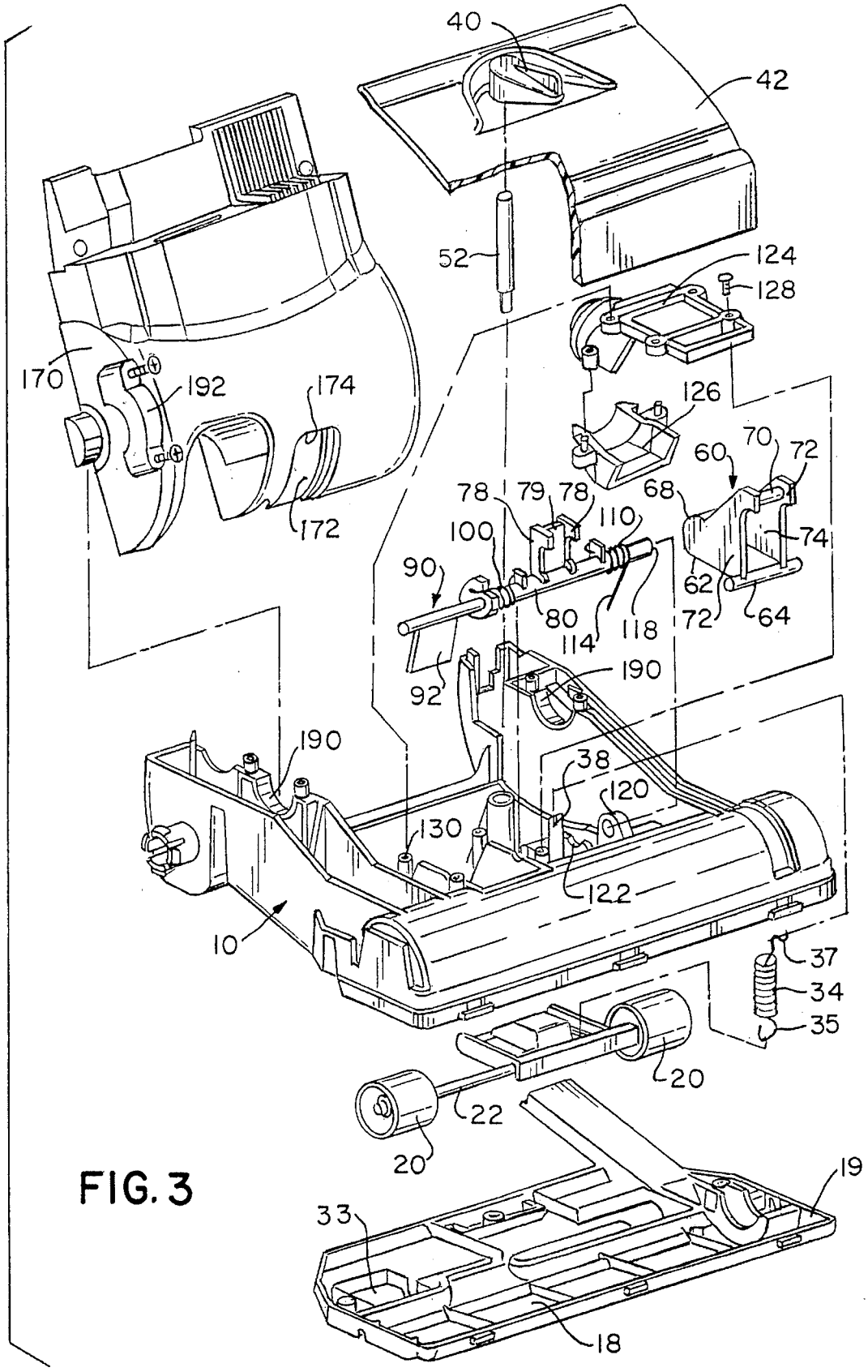
FIG. 3 is an exploded perspective view of the base of FIG. 2.
Figure 7:
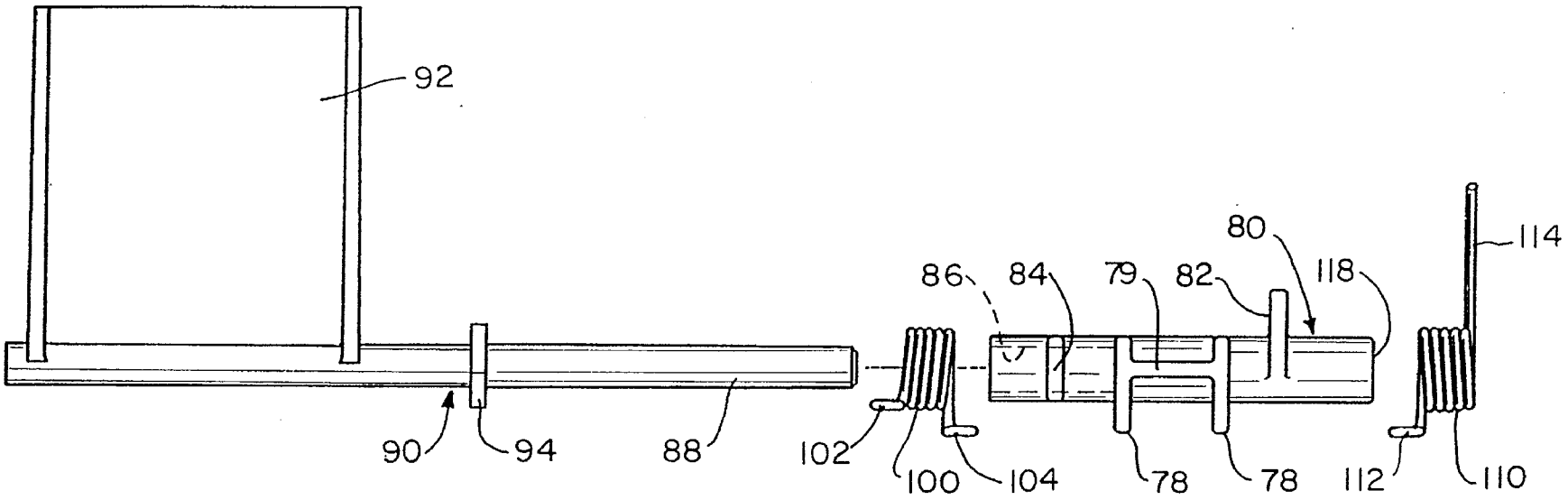
FIG. 7 is an enlarged exploded top plan view of a valve assembly for a suction conduit of the base illustrated in FIG. 6.

With reference now to FIG. 3, a roller lifter 60 cooperates with the nozzle raising assembly. The roller lifter comprises a first contact surface 62 located on a bottom face thereof and a cross pin 64 located forwardly of the first contact surface. The pin 64 engages a pair of spaced fingers 66 (see FIG. 8B) secured on the nozzle base 10 in order to allow the roller lifter to be pivotally mounted on the base. The roller lifter also includes a second contact surface 68 which is spaced rearwardly from the first contact surface 62 so that it is located on a rear face of the roller lifter. Located adjacent a front face of the roller lifter is a bridge 70 extending between a pair of arms 72 which define a hollow interior 74 of the roller lifter. Adapted to be located within the hollow interior 74 of the roller lifter is an arm construction, comprising a pair of spaced arms 78 connected by a bridge 79, of a connector means or sleeve 80. With reference now also to FIG. 7, the sleeve also includes a first finger 82 located on the one side of the arm construction and a second finger 84 located on the other side of the arm construction. The sleeve has a hollow interior 86 into which a stem 88 of a valve construction 90 can selectively extend. The valve construction also includes a valve member 92. Extending away from the stem 88 is a finger 94.

A first or overload spring 100 is adapted to slide onto the sleeve 80 from one end thereof. The first spring 100 includes a first end 102 which engages the finger 94 of the valve construction and a second end 104 which engages the second finger 84 of the sleeve. Adapted to slide onto another end of the sleeve is a second or return spring 110 which includes a first end 112 that engages the first finger 82 of the sleeve and a second end 114 which is adapted to engage a portion of the nozzle base 10, as best shown in FIG. 6.

With reference again to FIG. 3, a free end 118 of the sleeve is adapted to be held in a hoop 120 defined on the nozzle base 10. A depression 122 on a stem spaced from the hoop accommodates another portion of the sleeve 80. Thus the sleeve is rotatably mounted on the base. The valve member 92 is adapted to be housed in a dirt passage 123 (FIG. 8A) defined by a dirt passage cover 124 and a dirt passage base 126. These two parts are secured to each other by conventional means and, together, are secured by fasteners 128 in threaded apertures 130 defined on the nozzle base 10.

Figure 6:
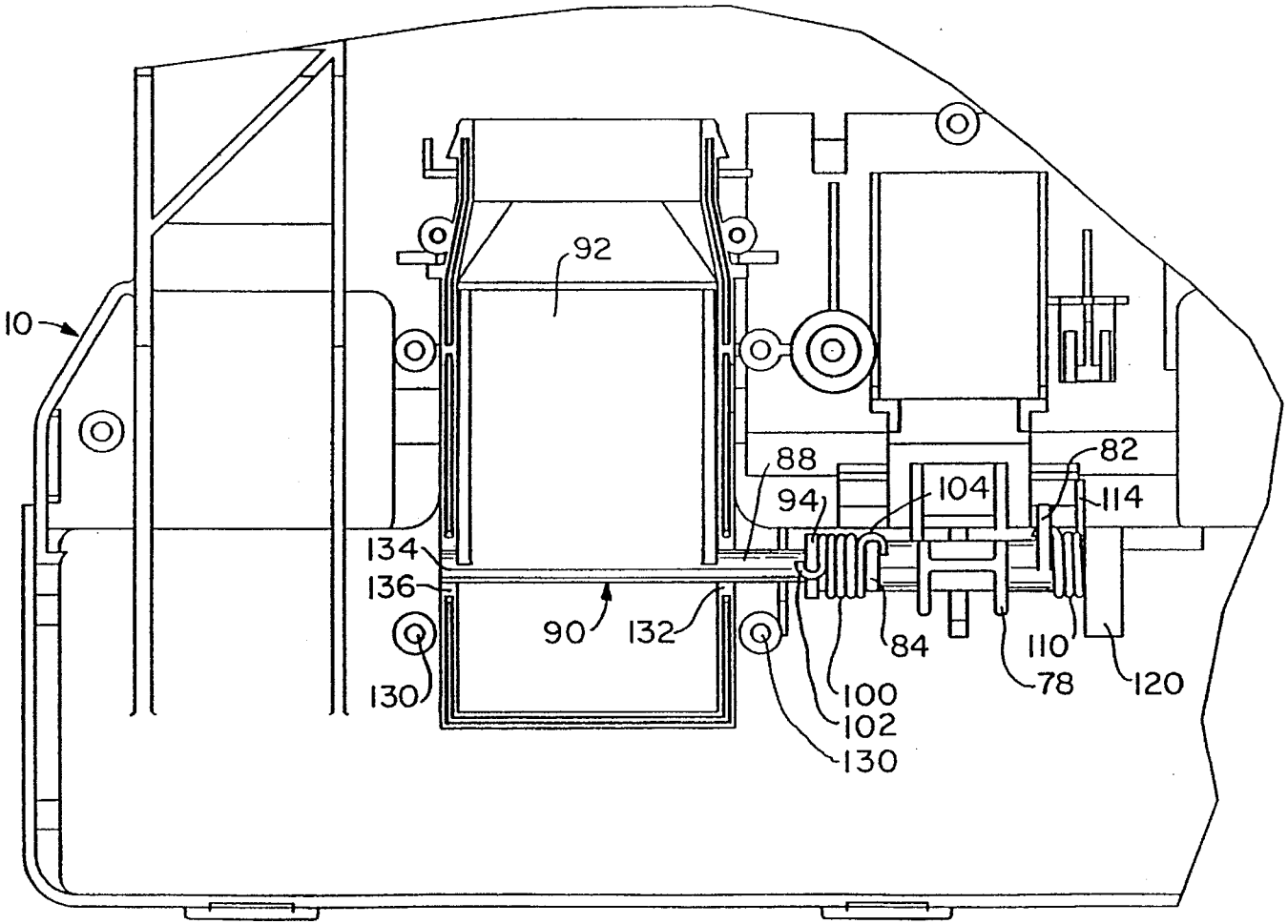
FIG. 6 is an enlarged top plan view of a portion of the base of FIG. 5, with certain parts removed for clarity.

With reference now also to FIG. 6, the stem 88 of the valve construction 90 is accommodated in an indented area 132 of the nozzle base 10 and a stem end 134 of the valve is accommodated in a second indented area 136 of the nozzle base. In this way, the valve construction 90 is also rotatably mounted on the base and can rotate as the sleeve 80 rotates.

As is illustrated in FIG. 5, the nozzle base 10 is supported at its rear by a pair of rear wheels 138. Thus the nozzle base 10 smoothly rolls on a subjacent support surface on the rear wheels 138 and the front wheels 20.

With reference again to FIG. 1, the handle portion of the vacuum cleaner comprises a back housing and back motor shell section 140 in which is secured a dirty air tube 142 which communicates via a bellows 144 with the dirt passage 123 in the nozzle base. A cover 146 can be sealingly secured on the base 140. A transverse wall 148 of the base closes a bottom of a suction chamber 150 defined by the back housing 140 and the cover 146. A slot 152 through the transverse wall 148 allows the dirty air tube to extend out of the suction chamber 150. A flange 154 of the dirty air tube 142 includes a slot for accommodating a filter 156 housed in a filter cage 158. Clean air flows out of the suction chamber 150 through the filter 156 and into a clean air tube 160. That tube directs the clean air to a motor and fan chamber 162. Cooperating with the back housing and back motor shell half 140 is a motor cover 170 in order to help enclose the motor 16 and the clean air tube 160 and define the motor and fan chamber 162.

Located in the motor cover 170 is an indented section or groove 172. This groove is aligned with a groove 174 defined in the back housing 140. An end wall 176 is provided for the groove 172 in the motor cover 170 (FIG. 8B). A secondary inlet 180 is defined in the dirty air tube 142. The secondary inlet communicates with an exterior of the base 140 via an aperture 182. Secured over the aperture 182 so as to communicate with the secondary inlet 180 is an auxiliary inlet or off-the-floor cleaning inlet assembly 184 of the vacuum cleaner. With the construction disclosed herein, on-the-floor cleaning operations can be performed with the brushroll 12 (FIG. 5). Alternatively, off-the-floor cleaning operations can be performed by securing one end of a conventional suction hose (not illustrated) to the auxiliary inlet assembly 184. When the auxiliary inlet assembly 184 is employed, the brushroll 12 is spaced away from the subjacent floor surface and air flow through the dirt passage 123 is blocked by the valve member 92. A manually engageable handle member 186 is secured to the body 140 in order to enable manual manipulation of the handle portion of the vacuum cleaner.

The back housing 140 and the motor cover 170 each have cooperating flanges 186, 188 which together define stub shafts on the two sides thereof. These stub shafts cooperate with suitably configured semi-circular indentations 190 (FIG. 4) located on each side of a rear portion of the base 10 in order to rotatably mount the handle on the base. Preferably, U-shaped connectors 192 (FIG. 3) are provided in order to secure the handle to the base.

Figure 8A:
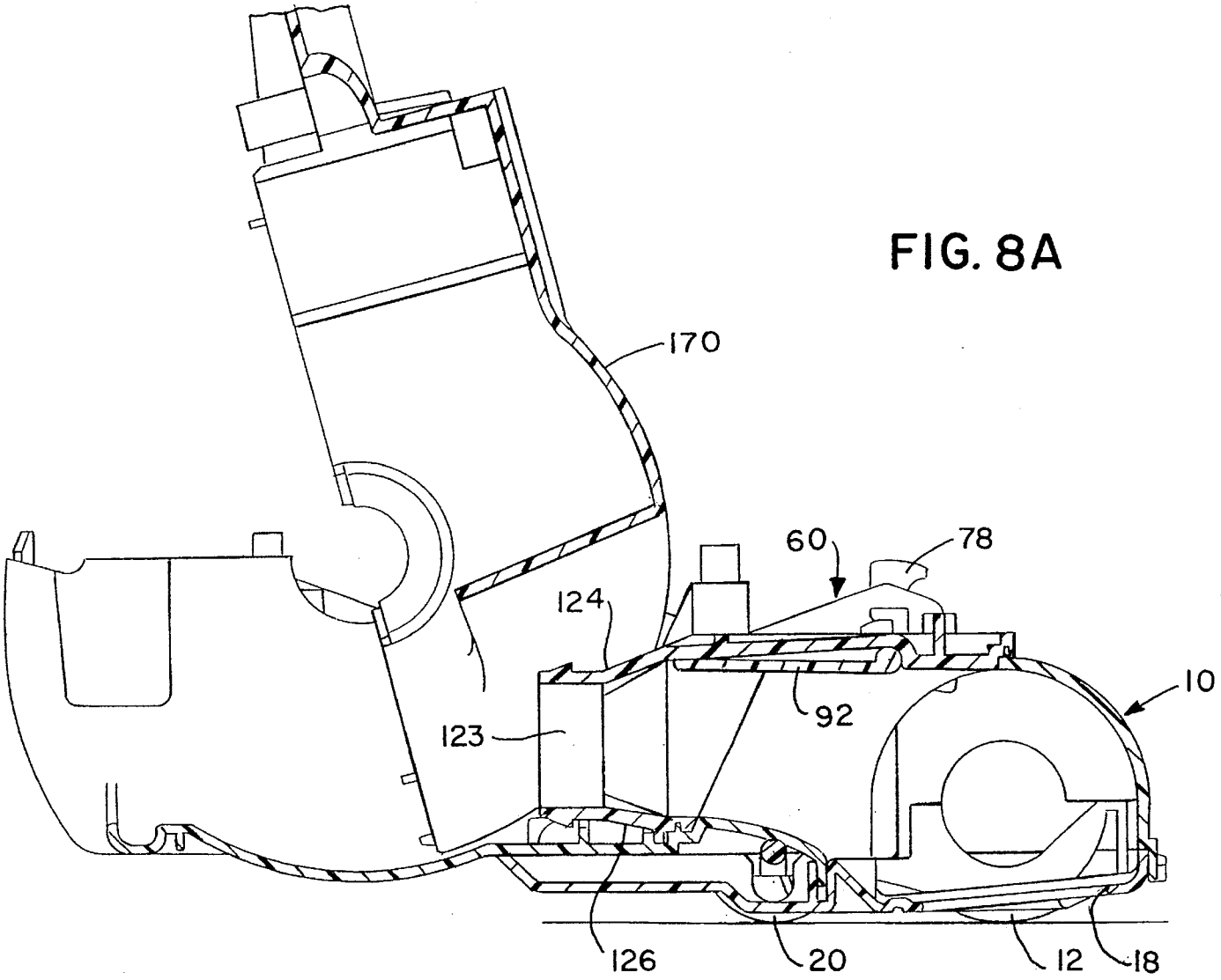
FIG. 8A is a cross sectional view through a first section of the assembled handle and base of the vacuum cleaner according to the present invention while the handle is in a reclining position.
Figure 8B:
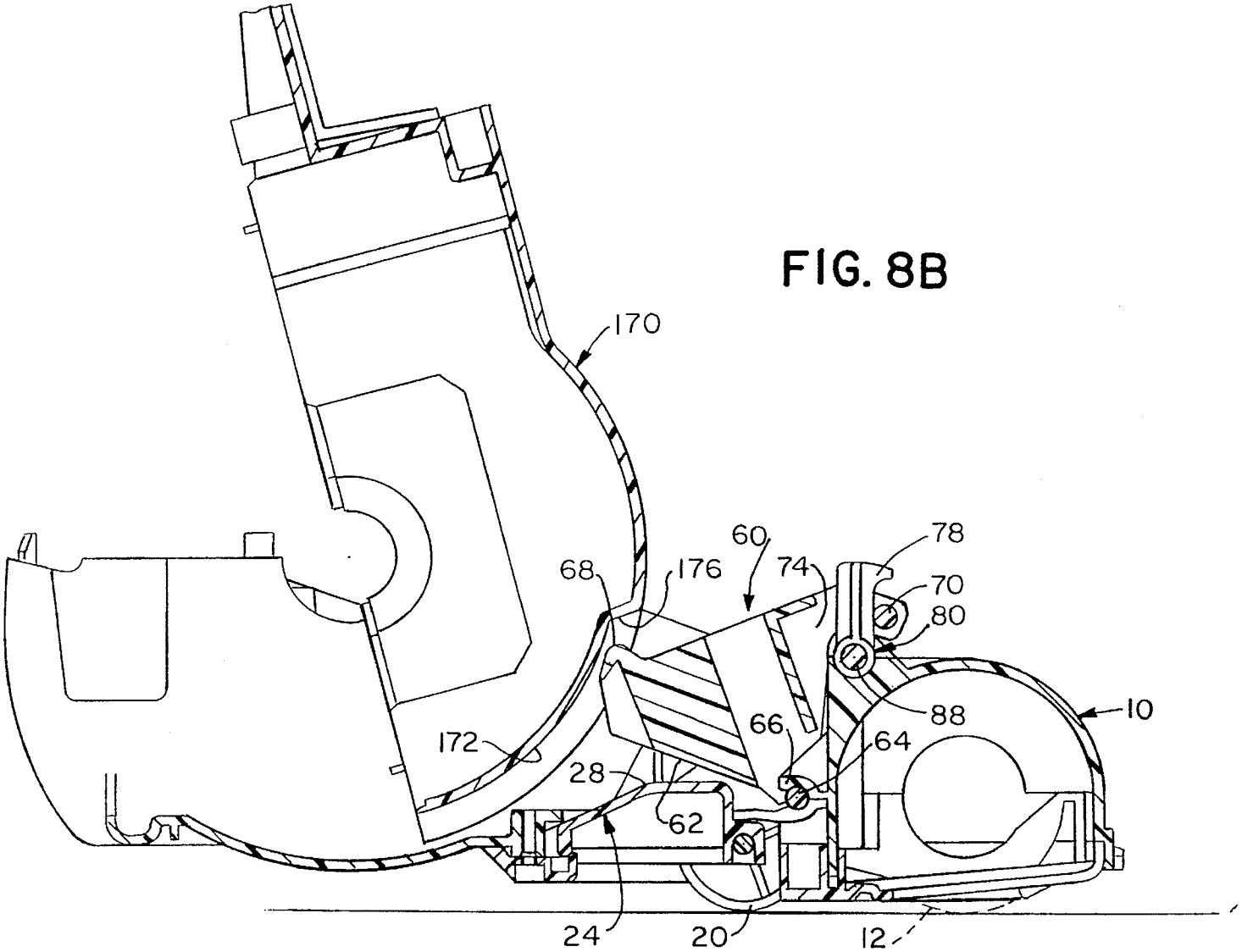
FIG. 8B is a cross sectional view through a second section of the assembled handle and base of the vacuum cleaner according to the present invention while the handle is in a reclining position.

With reference now to FIG. 8A, in a reclining orientation of the handle of the vacuum cleaner, the front wheels or rollers 20 are retracted into the base 10 in order to bring the nozzle 18 close to the subjacent floor surface and allow the brushroll 12 to contact the subjacent floor surface. At the same time, the valve member 92 is opened, allowing air to be drawn through the nozzle 18 and into the dirt passage 123. Simultaneously, and with reference now to FIG. 8B, the first contact surface 62 of the roller lifter 60 is spaced away from the ramp surface 28 of the cam follower plate 24 and the second contact surface 68 of the roller lifter is spaced away from the end wall 176 of the groove 172 defined in the motor cover 170.

The roller lifter 70 is rotated away from the cam follower ramp surface 28, around pin 64, because the bridge 70 thereof is pulled forward upon a rotation of the sleeve 80 as urged by the return spring 110. More specifically, the second end 114 of the spring 110 bears on the nozzle body 10 while the first end 112 thereof pulls on finger 82 of the sleeve 80 rotating the sleeve. This action pivots the arms 78 forwardly and the arms push the bridge 70 forwardly. Thus the return spring 110 insures that the roller lifter 60 will pivot around pin 64. Rotation of the sleeve 80 causes a rotation of the valve construction 90 because as the sleeve second finger 84 rotates, this will act on the second end 104 of the spring 100 causing its first end 102 to bias the finger 94 of the shaft 88 thereby rotating the valve member 92. Also helping to rotate the roller lifter 60 is the cam follower plate 24 as it is biased towards the roller lifter by the spring 34 so that the ramp surface 28 pushes upwardly on the first contact surface 62.

Figure 9A:
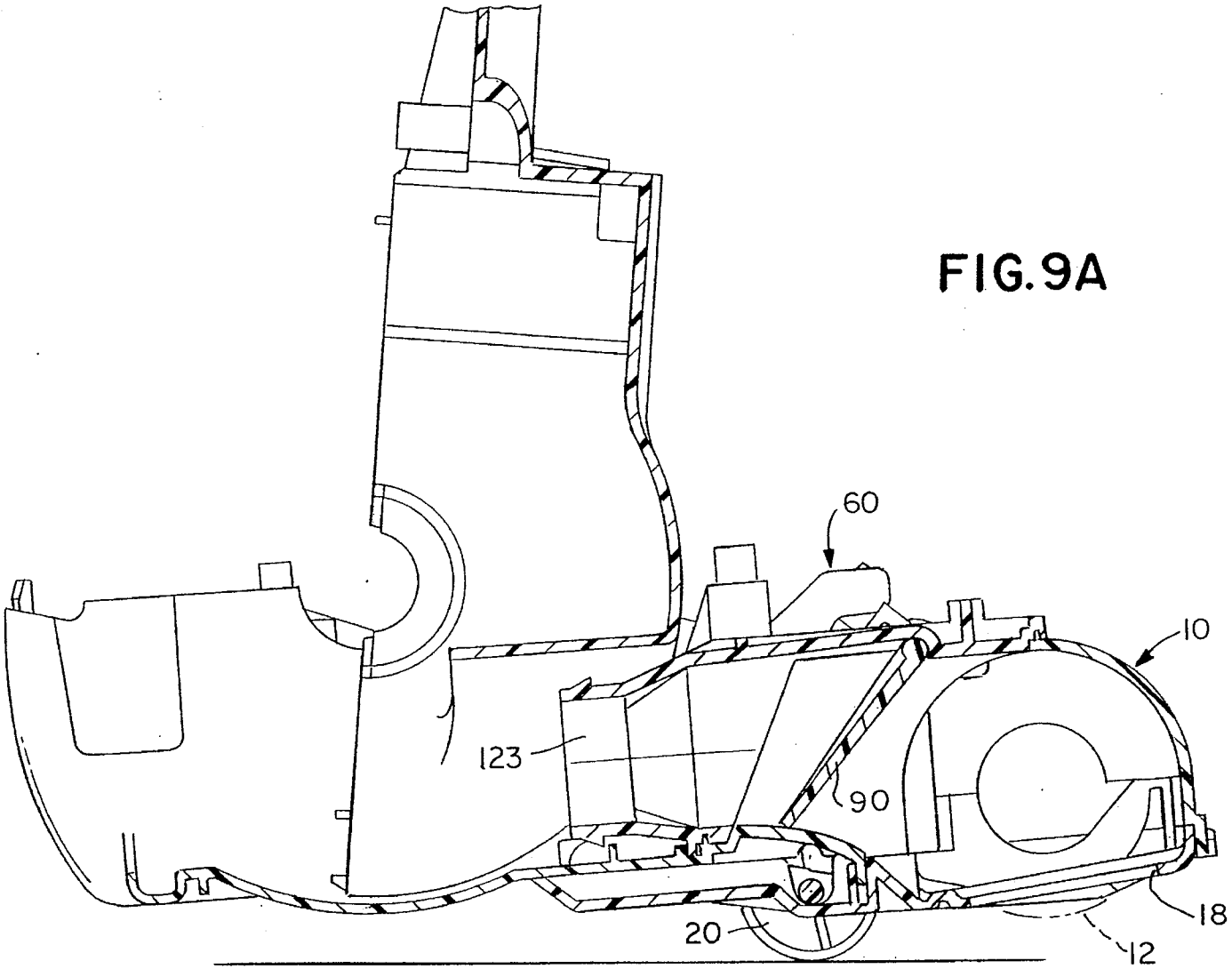
FIG. 9A is a cross sectional view of the handle and base much like FIG. 8A but with the handle in an upright position.
Figure 9B:
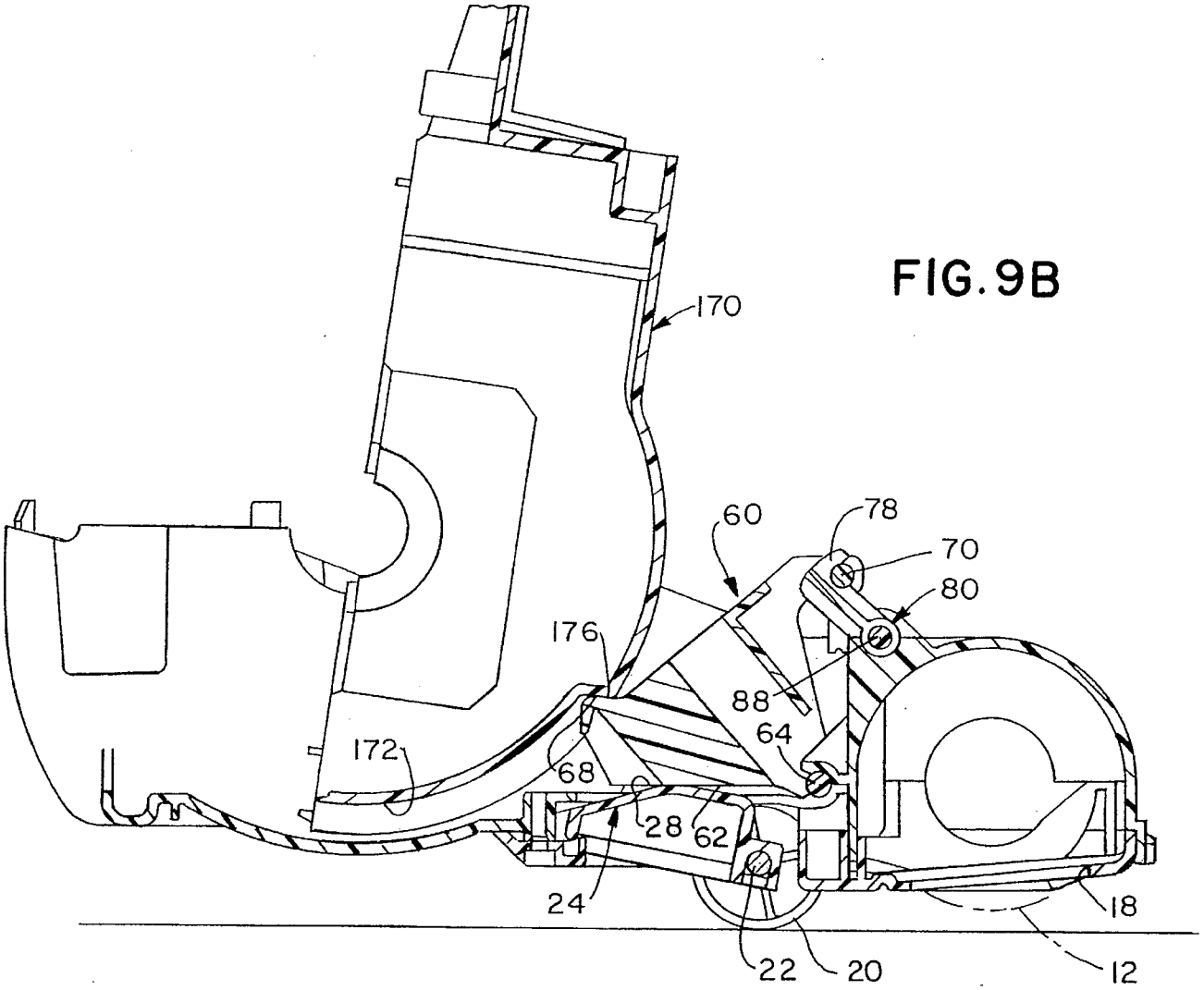
FIG. 9B is a cross sectional view of the handle and base much like FIG. 8B but with the handle in an upright position.

When the handle is moved into the upright position, the valve will be closed and the brushroll will be lifted away from the subjacent floor surface. With reference now to FIG. 9B, when the handle is moved to the upright position, the motor cover 170 rotates on the base 10 so that the end wall 176 engages the second contact surface 68 of the roller lifter 60. This will pivot the roller lifter around pin 64 bringing the first contact surface 62 of the roller lifter into contact with the ramp surface 28 of the cam follower plate 24 attached to the axle 22. The downward force exerted by the first contact surface 62 will pivot the axle 22 around shaft 30 (FIG. 2) thereby lowering the axle 22 and the wheels 20 and raising the brushroll 12 and the nozzle 18 away from the subjacent floor surface. At the same time, the bridge 70 of the roller lifter will engage the arms 78 of the sleeve 80 to rotate the sleeve counterclockwise. Such counterclockwise rotational movement of the sleeve 80 will be transmitted via the resilient bias of the pair of springs 100 and 110 to the valve stem 88. With reference now also to FIG. 9A, a rotation of the valve stem 88 will rotate the valve member 92 counterclockwise so as to block further air flow through the nozzle 18 and through the dirt passage 123. Therefore, all further suction by the motor and fan arrangement 16 will cause air flow through the auxiliary inlet 184.

If an obstruction is encountered by the valve member 92, the first or overload spring 100 comes into play. When the handle is raised to the upright position and the arms 78 are contacted by the bridge 70 of the roller lifter 60, thereby rotating the sleeve 80 and the valve element 90, the valve member 92 will be urged to move in such a way as to close the dirt passage 123. However, should a blockage be encountered in the passageway by the valve member 92, the overload spring 100 will allow a continued counterclockwise rotation of the sleeve 80 without a corresponding continued counterclockwise rotation of the valve shaft 88 and valve member 92 since such rotation of the shaft and the valve member is blocked by the obstruction which has been encountered by the valve member. In addition, the overload spring 100 is advantageous because it allows the valving assembly to compensate for any tolerance errors in the dimensions of the several components thereof.

When the handle is again lowered, i.e. pivoted backwardly away from its upright position perpendicular to the nozzle base 10, the groove end wall 176 of the cover 170 will no longer be engaging the second contact surface 68 of the roller lifter 60. At this point, the return spring 110 will bias the sleeve 80 and hence the valve shaft 88 so as to rotate them clockwise thereby raising the valve member 92 away from its blocking position in the dirt passage 123, as is illustrated in FIG. 8A. At the same time, the roller lifter will be pivoted around pin 64 as previously explained.

When the handle is moved to the upright position, the pin bottom end 54 is disengaged from the cam follower plate flat surface 26 as the roller lifter first contact surface 62 engages the ramped surface 28 of the cam follower plate 24. However, when the handle is moved back to the reclining position, the pin 52 will reengage the cam follower plate 24 in the same location of the cam. Thus the previously selected nozzle height is again obtained for the vacuum cleaner.

Figure 10:
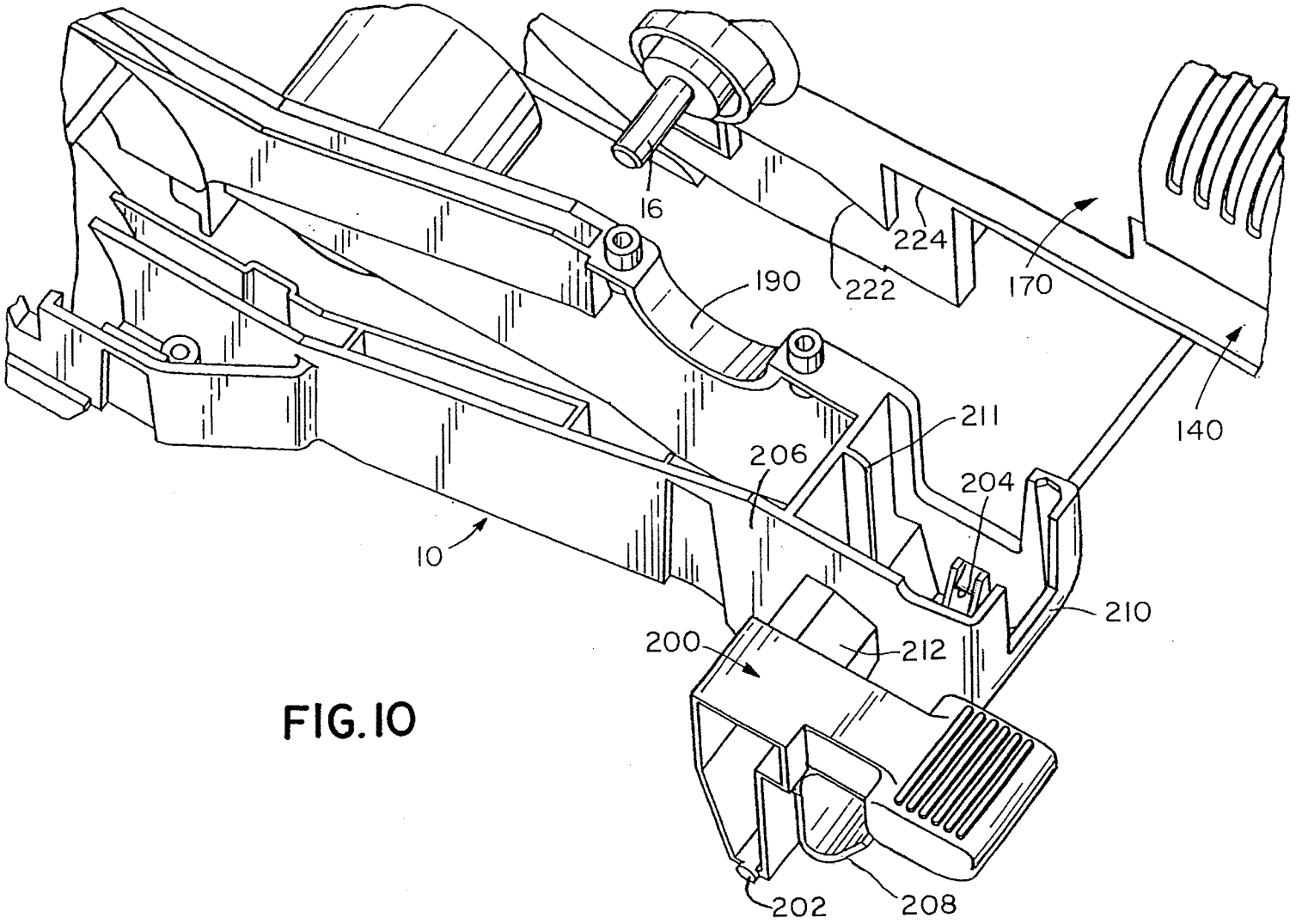
FIG. 10 is an enlarged exploded perspective view of a foot pedal and an adjacent section of the base and of the handle of the vacuum cleaner according to the present invention; and, FIG. 11 is an exploded side elevational view, partially broken away, of the base and an adjacent portion of the handle of the vacuum cleaner according to the present invention.

As is shown in FIG. 10, a foot operated pedal 200 is rotatably mounted in the base 10 via posts 202 on each side that hook under ledges 204 on the side walls of a pedal housing section 206 of the base. The pedal 200 thus rotates on an axis parallel to the axle 22. An integral spring 208 resiliently biases the pedal forwardly by acting against a rear wall 210 of the housing 206 until the pedal contacts a rib 211 of the housing 206. The pedal is utilized to lock the handle structure in the upright position in relation to the nozzle base 10. To this end, the pedal 200 includes an arm 212 extending normal to a longitudinal axis of the pedal.

Figure 11:
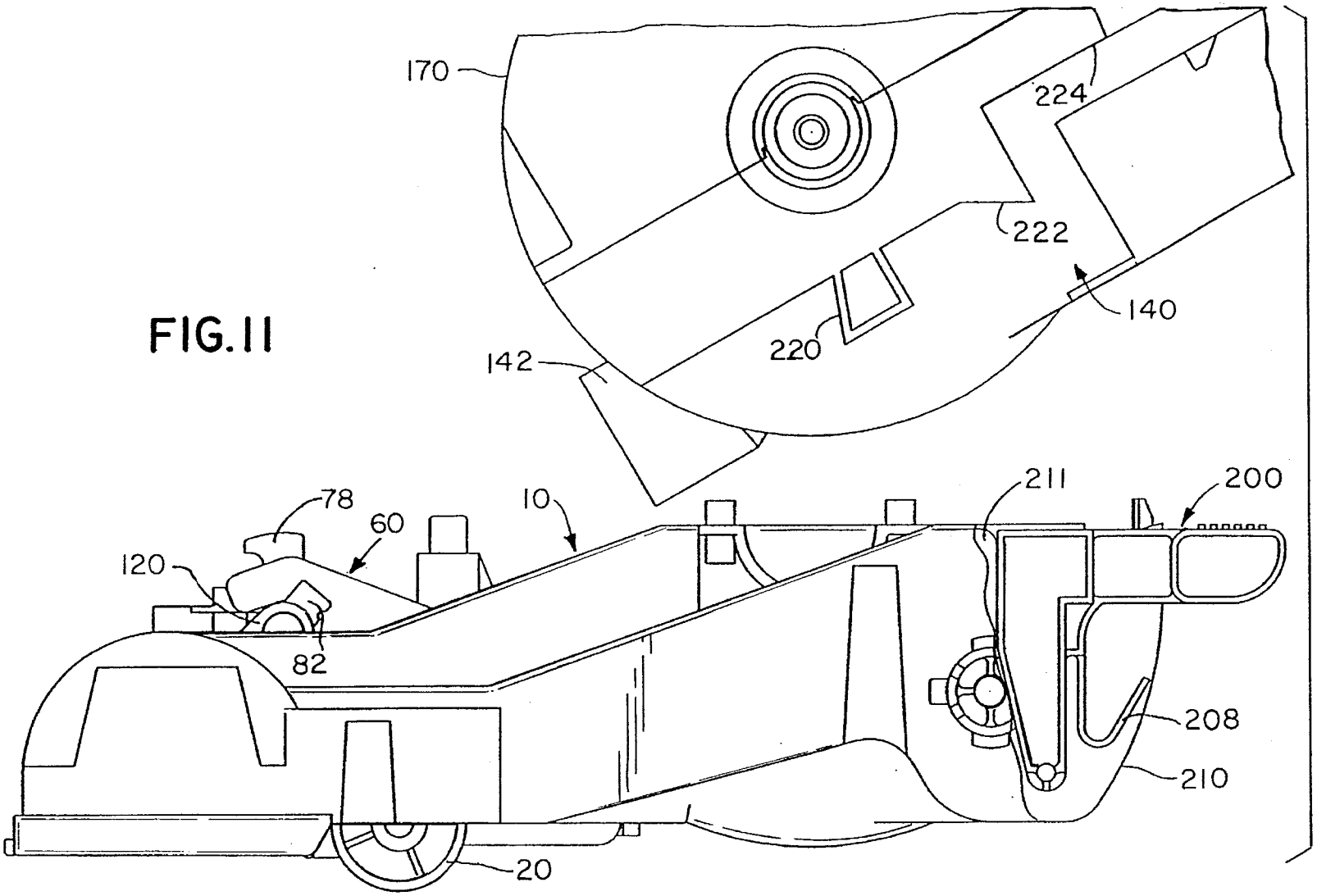

With reference now to FIG. 11, the arm cooperates with any one of three pedal stops 220, 222, 224 located on the back housing 140 to support the handle. When the handle is pivoted to the upright position, the back housing 140 is oriented in an upright position, normal to the base 10, so that a first pedal stop 220 is located above the arm 212 of the pedal. The pedal stop 220 contacts the arm 212 and prevents the handle from rotating clockwise in relation to the base 10. However, when the pedal 200 is depressed, i.e. rotated clockwise, the arm 212 is brought out of contact with the pedal stop 220 thereby allowing the handle to rotate clockwise in relation to the base 10. When the pedal 200 is released, the integral spring 208 thereof urges it counterclockwise until it contacts the rib 211. At this point, the arm 212 can contact the second pedal stop 222 on the back housing 140 in order to secure the handle in a first tilted orientation. In this position, the handle is disposed at an acute angle to the subjacent floor surface. This orientation is illustrated in FIG. 11. If the pedal 200 is again depressed, the arm 212 thereof is brought out of contact with the second pedal stop 222. The handle can now be lowered again. When the pedal 200 is released, the arm 212 thereof can now contact the third pedal stop 224 defined on the back housing 140. In this orientation, the handle is parallel to the base and the subjacent floor surface. The third pedal stop 224 prevents the handle from pivoting any further clockwise in relation to the base. Counterclockwise pivoting of the handle in relation to the base 10 allows the second pedal stop 222 and then the first pedal stop 220 to contact the arm 212 of the pedal 200 in order to lock the handle in either of the other two positions of the handle in relation to the base.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. A suction cleaner adapted for either on-the-floor or above-the-floor cleaning, comprising:

a base including a nozzle;

a handle pivotally secured to said base so as to be pivotable between a use position and a non-use position;

a suction passageway, located in at least one of said base and said handle, and communicating with said nozzle;

a valve rotatably mounted in said suction passageway for selectively closing said suction passageway;

an elevating means for selectively elevating said nozzle from and lowering said nozzle towards a subjacent floor surface, said elevating means being secured to said base; and, an actuating means for manually actuating said elevating means, said actuating means being secured to at least one of said base and said handle and engaging both said valve and said elevating means, said actuating means being selectively engaged by a portion of said handle so that when said handle is pivoted to said non-use position said actuating means drives said elevating means to elevate said nozzle from the subjacent floor surface and also drives said valve to close said suction passageway.

2. The suction cleaner of claim 1 wherein said actuating means comprises:

a roller lifter pivotally secured to said base; and, an interengaging member which connects said roller lifter to said valve.

3. The suction cleaner of claim 2 wherein said interengaging member comprises a sleeve including:

a cylindrical body having a hollow interior;

an arm extending away from said body;

a first finger extending away from said body and located on one side of said arm; and, a second finger extending away from said body and located on another side of said arm.

4. The suction cleaner of claim 2 wherein said roller lifter comprises:

a body including a hollow interior section defined by a pair of arms;

a pin secured to said body;

a bridge extending across said hollow interior between said pair of arms;

a first contact surface defined on said body; and, a second contact surface defined on said body wherein said second contact surface is spaced from said first contact surface.

5. The suction cleaner of claim 4 wherein said interengaging member comprises an arm which is positioned in said hollow interior section of said roller lifter body and engages said bridge thereof, and a sleeve which engages a stem of said valve.

6. The suction cleaner of claim 5 further comprising a first biasing means for urging said valve in a first direction in relation to said suction passageway, said first biasing means being mounted on said sleeve.

7. The suction cleaner of claim 6 further comprising a second biasing means for urging said interengaging member in a first direction, said second biasing means being mounted on said sleeve in a spaced manner from said first biasing means.

8. The suction cleaner of claim 1 further comprising a locking means for locking said handle in said non-use position.

9. The suction cleaner of claim 1 further comprising a height adjusting mechanism which cooperates with said elevating means.

10. The suction cleaner of claim 9 wherein said height adjusting mechanism comprises:

a manually accessible knob;

a cam member secured to said knob;

a pin slidably mounted in said base, wherein said pin has an upper end which engages said cam member and a lower end which engages said elevating means so that a movement of said cam member moves said pin and consequently said elevating means.

11. A suction cleaner comprising:

a base including a nozzle;

a handle pivotally connected to said base and movable between a use position and a non-use position;

a suction creating means located in one of said handle and said base;

a suction chamber located in one of said handle and said base;

an air passageway leading from said nozzle to said suction chamber;

a valve member pivotally mounted in said air passageway;

an elevating means for selectively elevating said suction inlet from and lowering said suction inlet towards a subjacent floor surface, said means being secured to said base; and, a roller lifter mechanism for manually actuating said elevating means, said roller lifter mechanism being pivotally secured to said base; and, a connecting means for engaging both said valve and said roller lifter, wherein when said handle is pivoted to said non-use position, said roller lifter mechanism is rotated and drives said elevating means to elevate said nozzle from the subjacent floor surface and simultaneously said connecting means drives said valve to close said suction passageway.

12. The suction cleaner of claim 11 wherein said connecting means comprises a sleeve including:

a cylindrical body encircling a hollow interior;

an arm extending away from said body;

a first finger extending away from said body and located on one side of said arm; and, a second finger extending away from said body and located on another side of said arm.

13. The suction cleaner of claim 12 wherein said roller lifter mechanism comprises:

a body including a hollow interior section defined by a pair of arms;

a pin secured to said body;

a bridge extending across said hollow interior between said pair of arms;

a first contact surface defined on said body; and, a second contact surface defined on said body wherein said second contact surface is spaced from said first contact surface.

14. The suction cleaner of claim 13 further comprising:

a return spring positioned on said sleeve for resiliently biasing said sleeve in a first direction; and, an overload spring positioned on said sleeve for resiliently biasing said valve in a first direction.

15. The suction cleaner of claim 11 further comprising a height adjusting mechanism including:

a manually accessible knob;

a cam member secured to said knob;

a pin slidably mounted in said base, wherein said pin has an upper end which engages said cam member and a lower end which engages said elevating means so that a movement of said cam member moves said pin and consequently said elevating means.

16. An upright vacuum cleaner which is convertible from an on-the-floor cleaning operation to an above-the-floor cleaning operation, the vacuum cleaner comprising:

a cleaner handle pivoted in an upstanding manner to a base having a nozzle;

a valve movably mounted in a suction passageway communicating with said nozzle for selectively closing said suction passageway;

an adjusting means for adjusting the height of said nozzle from a use position to a non-use position, said adjusting means being located in at least one of said handle and said base and comprising:

a front support assembly, and a roller lifter which cooperates with said front support assembly; and, a connecting means for engaging said roller lifter and said valve with each other, wherein when said roller lifter engages a portion of said handle, said roller lifter acts on said front support assembly and moves said nozzle away from a subjacent support surface and at the same time acts, via said connecting means, on said valve to close said suction passageway.

17. The vacuum cleaner of claim 16 wherein said roller lifter comprises:

a body including a hollow interior section defined by a pair of arms;

a pin secured to said body;

a bridge extending across said hollow interior between said pair of arms;

a first contact surface defined on said body; and, a second contact surface defined on said body wherein said second contact surface is spaced from said first contact surface.

18. The vacuum cleaner of claim 16 wherein said front support assembly comprises:

an axle;

a wheel rotatably mounted on said axle;

a cam follower plate secured on said axle; and, a pin located on said cam follower plate for rotatably securing said cam follower plate to said base.

19. The vacuum cleaner of claim 16 wherein said connecting means comprises:

a sleeve having a hollow interior;

an arm extending away from said sleeve;

a first finger extending away from said sleeve and located on one side of said arm; and, a second finger extending away from said sleeve and located on another side of said arm.

20. The vacuum cleaner of claim 16 further comprising a height adjusting mechanism including:

a manually accessible knob;

a cam member secured to said knob;

a pin slidably mounted in the suction cleaner, wherein said pin has an upper end which engages said cam member and a lower end which engages said front support assembly so that a movement of said cam member moves said pin and consequently said front support assembly.

21. The vacuum cleaner of claim 20 wherein said front support assembly comprises:

a wheel rotatably mounted on an axle; and, a cam follower plate, said cam follower plate comprising:

a first contact surface which is engaged by said pin, and a second contact surface, spaced from said first contact surface, which is engaged by said roller lifter.

22. The vacuum cleaner of claim 21 wherein said cam follower plate further comprises a pin, spaced from said first and second contact surfaces, for rotatably securing said cam follower plate to said base.

23. The vacuum cleaner of claim 22 further comprising a biasing means for biasing said cam follower plate towards said base.

24. The vacuum cleaner of claim 16 further comprising:

a pedal rotatably mounted on said base; and a locking means located on said handle and cooperating with said pedal for locking said handle in a first position to allow an above-the-floor cleaning operation.

25. The vacuum cleaner of claim 24 wherein said locking means comprises:

a pedal stop surface defined on said handle, wherein said surface cooperates with an arm of said pedal when said handle is rotated to said first position.

26. The vacuum cleaner of claim 24 further comprising a biasing means for biasing said pedal in a first rotational direction in relation to said base.

* * * * *